United States Patent [19]

Ramsey

[11] Patent Number: 4,781,360

[45] Date of Patent: Nov. 1, 1988

[54] SPRING ASSEMBLY WITH HELICAL COILS OF SPRING WIRE WITH UNKNOTTED ENDS

[75] Inventor: Henry R. Ramsey, Dudley, Mass.

[73] Assignee: Webster Spring Co. Inc., Oxford, Mass.

[21] Appl. No.: 129,549

[22] Filed: Dec. 7, 1987

[51] Int. Cl.[4] ..... A47C 23/02; F16F 3/04

[52] U.S. Cl. ..... 267/91; 5/248; 5/256; 5/269; 5/267; 267/97

[58] Field of Search ..... 267/91–101, 267/180, 166, 179, 110; 5/248–253, 256, 269, 267, 260

[56] References Cited

U.S. PATENT DOCUMENTS

| | | | |
|---|---|---|---|
| 1,744,389 | 1/1930 | Karr | 5/256 X |
| 1,798,885 | 3/1931 | Karr | 5/256 X |
| 1,879,172 | 9/1932 | Gail | 5/256 X |
| 1,887,058 | 11/1932 | Karr | 5/256 X |
| 2,374,850 | 5/1945 | Wunderlich | 5/256 X |
| 2,516,566 | 7/1950 | Hager | 5/269 |
| 2,581,686 | 1/1952 | McRoskey | 5/256 X |
| 3,052,460 | 9/1962 | Nachman, Jr. | 267/100 |
| 4,004,304 | 1/1977 | Kane | 5/256 X |
| 4,426,070 | 1/1984 | Garceau et al. | 5/267 X |
| 4,475,724 | 10/1984 | Hancock | 267/110 X |
| 4,639,957 | 2/1987 | Wells et al. | 5/248 |
| 4,699,362 | 10/1987 | Krakauer | 5/248 X |

*Primary Examiner*—Douglas C. Butler
*Attorney, Agent, or Firm*—Robert T. Gammons

[57] ABSTRACT

A spring assembly wherein there is a rectangular border wire and there are coils disposed in spaced, parallel rows within the border wire. The coils in the rows of coils lap and are connected by helices of wire. The helices of wire connect the adjacent rows of coils, and the coils adjacent the border wire are connected thereto by a helix of wire.

1 Claim, 1 Drawing Sheet

SPRING ASSEMBLY WITH HELICAL COILS OF SPRING WIRE WITH UNKNOTTED ENDS

BACKGROUND OF THE INVENTION

Conventional spring assemblies are comprised of spaced, parallel rows of helical springs. The upper and lower ends of the springs are knotted and adjacent springs in the rows are connected by helices of binding wire extending transversely of the rows from side to side of the assembly. The knots of the terminal coils at the upper and lower ends of the springs and the knotting of helical lengths of binding wire represent added manufacturing operations and costs. It is the purpose of this invention to eliminate the need for knotting the coils and to minimize the use of binding wire to thus reduce the cost of manufacture and the overall weight of the spring assembly.

SUMMARY OF THE INVENTION

A spring assembly comprising a plurality of spaced, parallel rows of helical springs disposed between vertically-spaced, parallel rectangularly configured border wires embodying spaced, parallel ends and spaced, parallel sides wherein the springs in each row are disposed in rectilinear relation to each other such as to form spaced, parallel, rectilinear rows of springs within the border wires, said springs having at their upper ends open-ended terminal coils, said springs being so oriented that the open ends of the terminal coils of one of two adjacent springs in a row of springs lap the terminal coils of the adjacent coils diametrically opposite the open end of the terminal coils of the adjacent springs, a helical length of wire extending transversely of the rows joining the overlapping portins of adjacent coils to each other and joining the rows of coils to each other and helical lengths of wire joining the coils adjacent the border wires to the border wires. In the preferred form, the overlapping portions of adjacent coils contain rectilinear deviations joined by the helical length of wire. Alternatively, adjacent coils may have overlapping portions of rectilinear and arcuate configuration joined by a helical length of wire.

Optionally, the terminal coils may be of generally rectangular configuration such as to provide rectilinear portions for attachment to each other and to the border wire.

The invention will now be described in greater detail with reference to the accompanying drawings, wherein.

Figure 1:
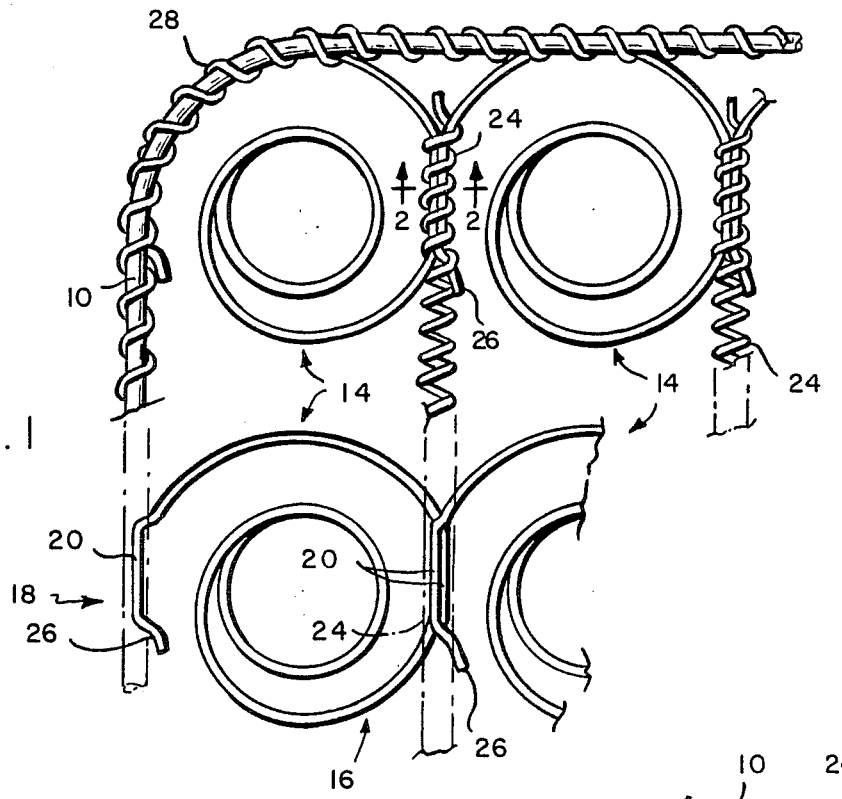
FIG. 1 is a fragmentary plan view at one corner of a spring assembly at the top side thereof.
Figure 1A:
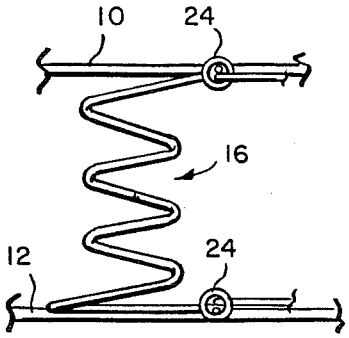
FIG. 1A is a fragmentary elevation showing a spring module connected at its upper and lower ends to, respectively, the upper grid frame and the lower grid frame.

Referring to the drawings, FIGS. 1 and 1A, the spring assembly comprises upper and lower border wires 10 and 12 of rectangular configuration. Within the border wires 10 and 12, there are disposed spaced, parallel rows 14 of spring modules 16 of helical configuration. The upper and lower ends of the modules 16 are of identical construction.

In the preferred form shown in FIG. 1, the upper and lower end of each spring module has an open terminal coil 18 and diametrically-disposed, outwardly-extending, spaced, parallel, rectangular deviations 20—20. The spring modules 16 are mounted between the border wires 10 and 12 in spaced, parallel rows 14, FIG. 1, with the spring modules 16 in the rows 14 in overlapping adjacency. In accordance with the invention, the spring modules 16 in the rows are connected to each other at their upper and lower ends and to the border wires 10 and 12 by helical lengths of wire 24 and 28, FIGS. 1 and 2.

Figure 2:
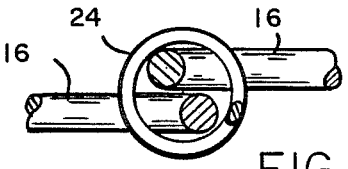
FIG. 2 is an enlarged section taken on the line 2—2 of FIG. 1.

Referring to FIG. 1, the upper ends of the modules 16 within the border wire 10 are disposed with the deviations 20—20 in adjacent modules lapping as shown in FIG. 2 and bound to each other by the helical lengths of wire 24. The helical wires 24 extend transversely from row to row, tying the adjacent rows of modules to each other in spaced, parallel relation. As shown, the ends of the helical length of wire 24 are not connected to the border wire. At the corners adjacent the sides of the border wires, the terminal coils 18 of the corner modules are anchored to the border wire 10 by a helical length of wire 28. As thus described, the modules 16 in the rows 14 are connected to each other by the helical lengths of wire 24 and adjacent rows of modules are attached to each other by the helical lengths of wire 24. The terminal ends 26 at the terminal coils of the upper and lower coils of the modules are locked within the helical lengths of wire 24 and 28. The lower ends of the module 16 are connected to each other and to the border wire 12 in the same way as the upper ends are connected to the border wire 10.

Figure 3:
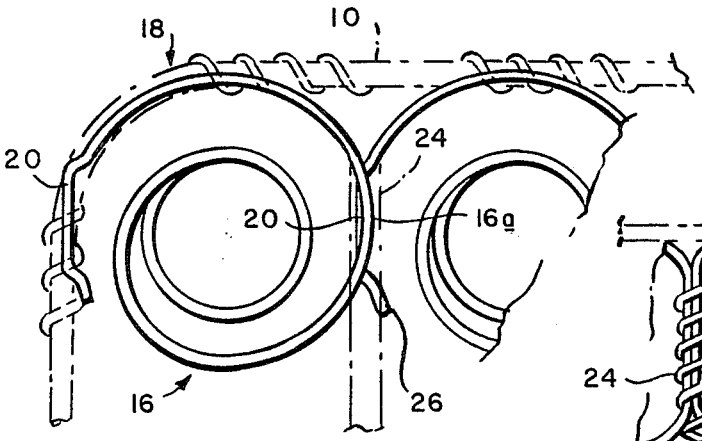
FIG. 3 is a fragmentary plan view of an alternative form of the spring assembly.

A modification of the aforesaid structure is shown in FIG. 3 wherein deviations 20 are formed in one side only of the upper and lower ends of the modules 16. The opposite side of the module **16*a* are left arcuate. The overlapping portions 20,16*a* are, in the same way, as illustrated in FIGS. 1 and 2, bound to each other by helical coils 24**.

Figure 4:
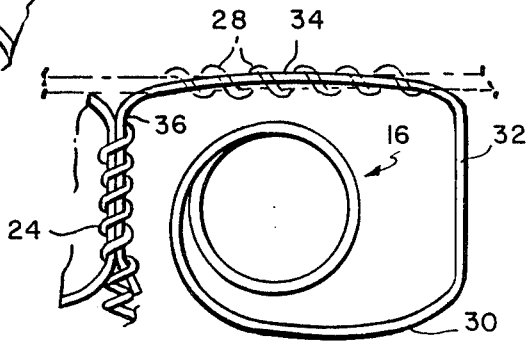
FIG. 4 is a fragmentary plan view of a modification wherein the upper ends of the coils are of generally rectangular configuration.

A further modification of the structure is shown in FIG. 4 wherein the upper and lower ends of the coils are of generally rectangular configuration rather than circular comprising generally rectilinear lengths 30, 32, 34 and 36. The coils as thus configured provide substantially straight lengths of wire for attachment to adjacent coils and straight lengths of wire for attachment to the border wire. The straight lengths of wire provide for receiving helical lengths of wire of sufficient length to stabilize the connection of the coils to each other and to the border wire.

It should be understood that the present disclosure is for the purpose of illustration only and includes all modifications or improvements which fall within the scope of the appended claims.

What is claimed is:

1. A spring assembly comprising a continuous border wire of rectangular configuration defining spaced, parallel sides and ends, a plurality of spaced, parallel rows of spring modules of helical coil springs disposed within the border wire, said springs in each row being disposed in rectilinear relationship to each other such as to form spaced, parallel rows of springs parallel to two of the spaced, parallel sides or ends, said springs having at their upper ends open-ended, unknotted terminal coils, said coils being so arranged within the border wire that the terminal coils of adjacent coils in each row of coils lap and that the terminal coils of the coils adjacent the sides and ends of the border wire lap the border wire and, further, that the terminal coils of one of two adjacent springs in a row of springs lap the terminal coils of the adjacent springs diametrically opposite the open ends of the terminal coils of the adjacent springs and wherein a helical length of wire extending transversely of the rows, the length of wire being of a length less than the distance between sides and/or ends of the border wire join the lapping portions of adjacent springs in each row of coils and wherein said helical lengths of wire connecting the terminal coils of the springs in adjacent rows of springs and wherein a continuous helical length of wire disposed about the sides and ends of the border wire connects the terminal coils of the coils adjacent the sides and ends to the border wire and wherein the coils at the sides and ends are so oriented that the open ends of the terminal coils of the coils at the sides and ends are disposed in alignment with the sides and ends such as to be lockingly confined within the helices of the helical length of wire disposed about the border wire, the ends of the helical lengths of wire adjacent the border wire being unknotted, and not connected to the border wire, wherein said open ends of said open-ended terminal coils embody terminal ends in the form of deviations disposed in the plane of the terminal coils which extend radially outward with respect to the centers of the terminal coils and wherein said deviations lap each other and said lapping portions are confined within the helices, the deviations being spaced from the terminal ends of the terminal coils, the springs having corresponding open-ended terminal coils at their lower ends correspondingly connected, the spring assembly eliminating knotting of coils to minimize the use of binding wire to thus reduce the cost of manufacture and weight of the spring assembly, the plurality of spaced, parallel rows of helical springs being disposed between vertically-spaced, rectangularly configured such border wires.

* * * * *